United States Patent [19]

Donk et al.

[11] 4,051,994

[45] Oct. 4, 1977

[54] BAG CLOSURE

[75] Inventors: Daniel Lawrence Donk, Phelps; Robert Hutchins Olson, Pittsford, both of N.Y.

[73] Assignee: Mobil Oil Corporation, New York, N.Y.

[21] Appl. No.: 640,319

[22] Filed: Dec. 12, 1975

Related U.S. Application Data

[63] Continuation of Ser. No. 387,557, Aug. 10, 1973, abandoned.

[51] Int. Cl.[2] ..... B65D 33/30

[52] U.S. Cl. ..... 229/65; 150/3

[58] Field of Search ..... 229/62, 65, 87 B; 150/3, 7

[56] References Cited

U.S. PATENT DOCUMENTS

| | | | |
|---|---|---|---|
| 892,330 | 6/1908 | Tavis | 229/65 |
| 2,202,880 | 6/1940 | Wentz | 229/65 |
| 3,330,469 | 7/1967 | Koncak | 229/65 |
| 3,402,052 | 9/1968 | Walker | 229/87 B |

FOREIGN PATENT DOCUMENTS

| | | | |
|---|---|---|---|
| 26,505 | 8/1906 | United Kingdom | 229/65 |

*Primary Examiner*—George E. Lowrance
*Assistant Examiner*—Douglas B. Farrow
*Attorney, Agent, or Firm*—Charles A. Huggett; James D. Tierney

[57] ABSTRACT

A lay flat thermoplastic bag construction having an integral closure means comprising a strip of metallic foil which is secured to one of the bag walls adjacent the open mouth of the bag.

3 Claims, 6 Drawing Figures

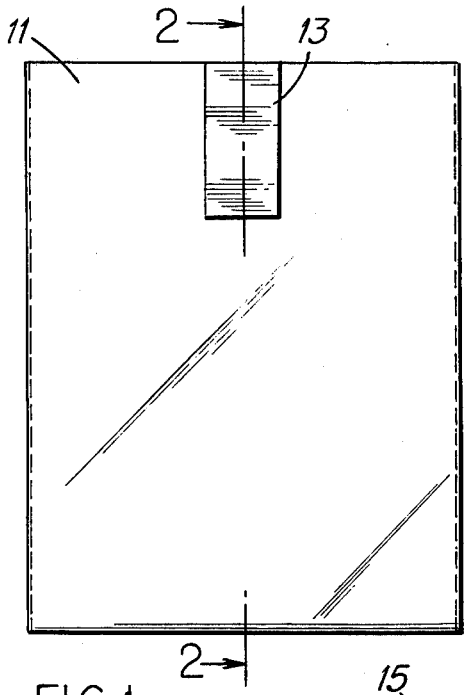
FIG.1
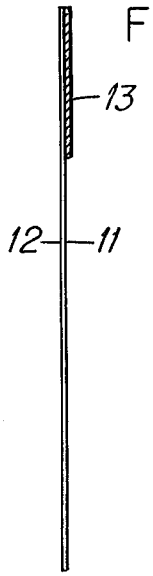
FIG.2
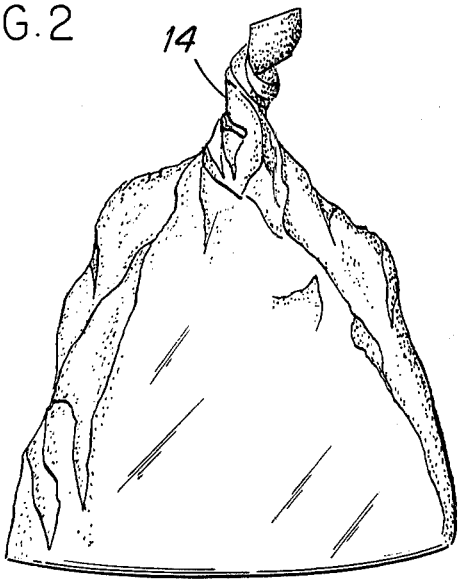
FIG.3
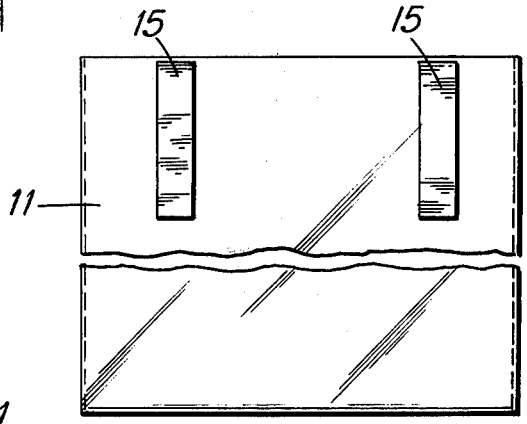
FIG.4
FIG.5
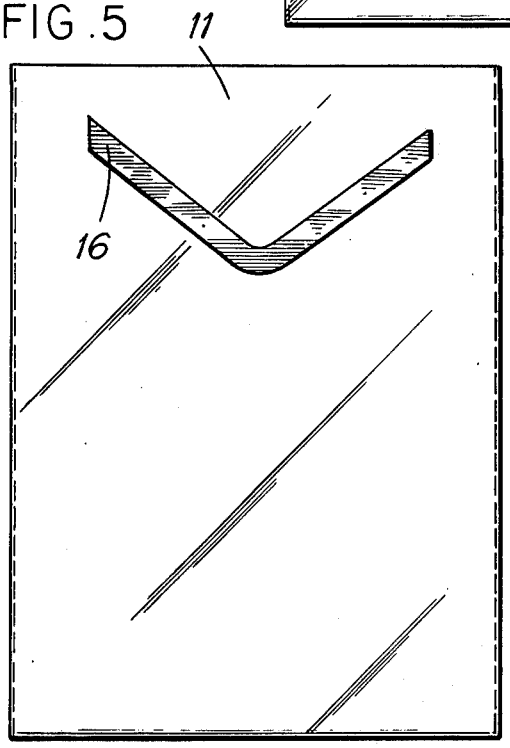
FIG.6
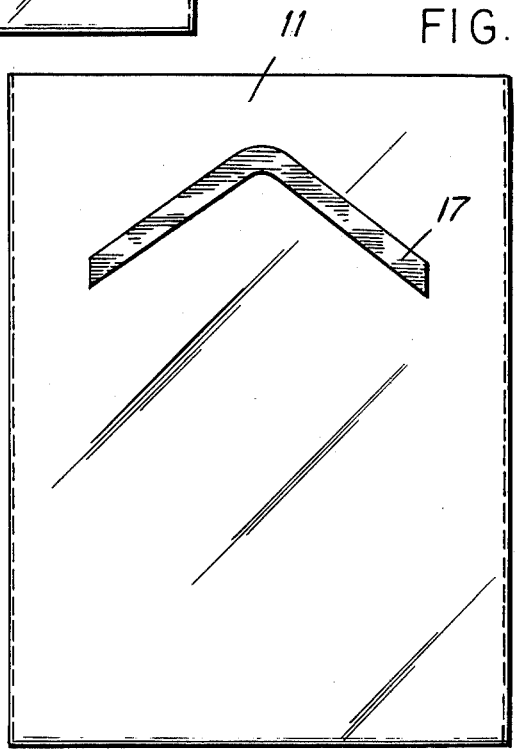

BAG CLOSURE

This is a continuation of application Ser. No. 387,557, filed Aug. 10, 1973 now abandoned.

BACKGROUND OF THE INVENTION

The present invention relates to bag structure and particularly thin wall bags fabricated from thermoplastic materials such as polyolefins, including polyethylene and polypropylene. The bags of the present invention are characterized by having an integral closure feature whereby when it is desired to close the open mouth of the bag the mouth is merely gathered together, twisted, and released. The bag mouth retains its closed, twisted configuration without the employment of extraneous fastening devices.

In the past, thin walled thermoplastic bags were usually closed by gathering the top end of the bag over the contents, twisting the gathered end and tying the twisted neck of the bag for example, with a rubber band or a length of paper coated wire commonly referred to as a twist-tie. Such closing means are often supplied by the bag manufacturer as a separate item in the package of bags. These closures have a common characteristic, i.e., they are separate from the bag so that frequently they are not at hand when needed. U.S. Pat. No. 3,402,052 discloses the employment of strips of metallic foil which are adhered along the entire length of bread overwrap material so that, after opening, the bread package may be reclosed by twisting the neck of the wrapper closed. The twisted end of the package, by virtue of the dead-fold characteristics of the metallic foil, remains closed until it is desired to reopen the package by untwisting the package end. Such a closure arrangement requires a considerable amount of metallic foil, a relatively expensive commodity, to function effectively.

SUMMARY OF THE INVENTION

A thermoplastic bag comprising a front and rear wall continuously joined together along their bottom and side edges, the bag being open at the top along the top edges of the front and rear walls.

At least one strip of metallic foil is secured to one of the bag walls adjacent the open bag top. The foil strip has a longitudinal dimension at least as great as its width and is disposed on the upper portion of the bag wall so that its longitudinal dimension is in a direction other than horizontal to the width of the bag. The foil strip may assume a configuration such as rectangular or, in a specific embodiment, a chevron or V-like configuration.

BRIEF DESCRIPTION OF THE DRAWINGS

FIG. 1 is a plan view of an embodiment of the present container structure.

FIG. 2 is a sectional view taken along line 2—2 of FIG. 1.

FIG. 3 is a perspective view of the container, illustrated in FIG. 1, in a closed condition.

FIG. 4 is a plan view of an alternate embodiment of the present container structure.

FIG. 5 is a plan view of another specific embodiment of the present container.

FIG. 6 is a plan view of still another alternate embodiment of the structure of the present invention.

DESCRIPTION OF SPECIFIC EMBODIMENTS

As illustrated in FIGS. 1 and 2 the container structures of the present invention include a bag structure particularly adapted for the packaging of sandwiches. However, it will be understood that the container may assume varying forms. As shown in FIGS. 1 and 2 the bag structure is comprised of substantially identical front 11 and rear wall 12 portions continuously joined along their bottom and side edges. A preferred material of construction is polyethylene film having a thickness of from about 0.5 up to about 2 mils. A substantially rectangular strip of aluminum foil 13, having a thickness of about 0.5 to about 5.0 mils is secured to the outside surface of bag wall 11, at about the center thereof and adjacent the upper edge of wall 11. The foil 13 may be secured to bag wall 11 by thermal bonding or, alternatively, adhesives may be employed. Examples of suitable adhesives include those compounded from elastomerics i.e. partially hydrogenated butadienes, neoprenes, nitriles etc, and vinyl acrylic copolymers and polyamides. As illustrated in FIG. 3, when it is desired to close the bag structure, the upper portion of the bag is gathered around the bag contents, e.g. sandwich, and twisted. The neck 15 of the bag will retain its twisted condition by virtue of the presence of foil element 13 which imparts dead-fold characteristics to the polyethylene gathered around twisted foil element 13 after the mouth of the bag has been twisted closed. The closed bag is easily reopened by untwisting the gathered neck portion. Such a closure arrangement allows for repeated closing and reopening of the thermoplastic bag structure.

It has been found that by arrangment of aluminum foil element 13, as shown FIG. 1, with the long axis of the rectangular strip 13 perpendicular to the open mouth of the bag, a secure twist closure is achieved utilizing a minimum amount of foil material. Such an arrangment provides for the foil to extend substantially the entire depth along the axis of twist 14 to insure retention of the closed, twisted configuration of the bag mouth.

The bag structure illustrated in FIG. 4 is similar to that shown in FIG. 1, however, as shown, the structure of FIG. 4 has two strips of metallic, e.g. aluminum, foil positioned adjacent opposite side edges of bag wall 11, near the open mouth of the bag. Such an arrangement of foil elements has been desirable when the width of the bag walls is such that a single, centrally located foil strip will not function to provide an adequate twist closure, i.e., will not hold or retain the twisted bag mouth in a tightly twisted configuration after the closed bag mouth is released. As in the case of the structure shown in FIG. 1 rectangular foil elements 15 are positioned on the outer surface of wall 11 so that the long axis of elements 15 are generally prependicular to the bag mouth thereby insuring that the elements 15 will extend the entire depth of the twisted neck of the bag after twist closure thereof.

FIG. 5 illustrates still a further embodiment of the container closure arrangment of the present invention. As shown in FIG. 5 a single strip of metallic foil 16 having a chevron or V-like shape is secured to the front wall 11 of the bag structure near the open mouth of the bag, the apex of the foil element 16 pointing in the direction of the bag bottom. The legs of V-like element 16 extend upwardly and outwardly terminating adjacent the upper corners of the bag mouth. It will be seen that the V-like configuration of foil element 16 has both a horizontal and vertical dimension. Thus, when the open mouth portion of such a bag structure, i.e., FIG. 5, is twisted closed the dead fold characteristics of foil element 16 will be provided across substantially the full width of the bag mouth while at the same time the vertical dimension or depth of the V-like strip will provide dead-fold characteristics to the twisted bag mouth in a direction corresponding to the longitudinal axis of the twisted bag neck. Such an arrangement provides for an extremely tight and permanent set to the twist closure and is achieved with a minimum amount of metallic foil.

The bag closure embodiment of the present invention as illustrated in FIG. 6 is similar to that shown in FIG. 5, however in FIG. 6 embodiment metallic foil element 17 has an inverted V-like configuration, the apex of the V being adjacent to and pointing towards the open bag mouth while the legs of the inverted V-like foil element 17 extend downwardly and outwardly terminating adjacent the upper area of the side edges of front bag wall 11. Such an arrangement functions as a bag closure element in much the same manner as the closure arrangement of FIG. 5. When the open mouth of the bag is twisted closed, foil element !7 provides deadfold characteristics across the width of the bag and, additionally, the inverted V-like configuration, by virtue of its vertical dimension or depth, provides dead-fold action in a direction corresponding to the longitudinal axis of the twisted bag mouth. A very tight and secure closure is thereby provided.

Although the container structures of the present invention have been shown in the accompanying drawings as individual containers, it will be understood that the present recloseable bag structures may be formed in a continuous strip of bags which are separably joined together and packaged in roll form. For example, the bags may be joined together along their height or width dimension by transverse seal lines having a series of perforations in said seal line area or immediately adjacent thereto for ease of dispensing individual bags by tearing along the perforations.

Although the container closure element of the present invention is preferably formed of a thin metallic foil such as aluminum, stiff paper or metal foil laminates and the like, any material which possesses the necessary characteristic of being capable of a shape retaining dead fold when crimped together may be employed. The material must retain a given fold or crimp to prevent unfolding and uncurling of the thin plastic film comprising the bag mouth. The crimpable material, if desired, may also be bonded to the inside surface of the bag walls, rather than the outside surface as described in the foregoing specific embodiments.

Although the present invention has been described with preferred embodiments, it is to be understood that modifications and variations may be resorted to without departing from the spirit and scope of this invention, as those skilled in the art will readily understand. Such variations and modifications are considered to be within the purview and scope of the appended claims.

What is claimed is:

1. A thermoplastic bag comprising a front wall and a rear wall continuously joined together along the bottom and vertical side edges, said bag being opened at the top along the top edges of said front and rear walls, a single strip of metallic foil secured to one of said walls adjacent said open top edges of said bag, said foil being in the form of a V-like configuration with the apex of said V being vertically oriented with respect to said bag walls.

2. A thermoplastic bag in accordance with claim 1 wherein the apex of said V-like metallic strip is directed towards said bag wall bottom edge and the legs of said V-like strip extend upwardly and outwardly across said bag wall, terminating adjacent the upper edge of said wall.

3. A thermoplastic bag in accordance with claim 1 wherein the apex of said V-like metallic strip is directed towards said bag wall top edge and the legs of said V-like strip extend downwardly and outwardly across said bag wall, terminating adjacent the vertical side edges of said bag wall.

* * * * *

UNITED STATES PATENT AND TRADEMARK OFFICE

CERTIFICATE OF CORRECTION

PATENT NO. : 4,051,994

DATED : October 4, 1977

INVENTOR(S) : DANIEL L. DONK and ROBERT H. OLSON

It is certified that error appears in the above-identified patent and that said Letters Patent are hereby corrected as shown below:

Column 3, line 24 "!7" should be --17--.

Column 4, line 29 "walls" should be --wall--.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*